United States Patent [19]

White

[11] 4,319,470

[45] Mar. 16, 1982

[54] LEVER TYPE DOOR HANDLE

[76] Inventor: William P. White, c/o Mechanical Applications, Inc., Wiscasset, Me. 04578

[21] Appl. No.: 121,009

[22] Filed: Feb. 13, 1980

[51] Int. Cl.[3] ..... E05B 1/00; E05B 3/00; E05B 3/04; E05B 13/10

[52] U.S. Cl. ..... 70/224; 70/370; 70/DIG. 39; 292/347; 292/350

[58] Field of Search ..... 70/224, DIG. 31, DIG. 39, 70/370, 451; 292/350, 347, 359, 336.3

[56] References Cited

U.S. PATENT DOCUMENTS

| | | | |
|---|---|---|---|
| 182,111 | 9/1876 | Gonne | 292/350 |
| 510,968 | 12/1893 | Gonne | 292/350 |
| 1,619,097 | 3/1927 | Archer | 292/350 X |
| 1,653,514 | 12/1927 | Schlage | 292/347 |
| 2,677,953 | 5/1954 | Fisler et al. | 70/224 |
| 3,338,613 | 8/1967 | Kendrick | 292/347 |
| 3,503,233 | 3/1970 | Russell et al. | 70/451 X |
| 3,597,946 | 8/1971 | Mikkelson | 70/224 |
| 3,718,015 | 2/1973 | Tornoe et al. | 292/347 X |

FOREIGN PATENT DOCUMENTS

| | | | |
|---|---|---|---|
| 308780 | 10/1918 | Fed. Rep. of Germany | 292/350 |
| 23200 | 5/1921 | France | 292/350 |

*Primary Examiner*—Francis K. Zugel
*Assistant Examiner*—Carl F. Pietruszka
*Attorney, Agent, or Firm*—C. Yardley Chittick

[57] ABSTRACT

A lever type door handle assembly adapted to be mounted on a conventional lock spindle which may or may not include a lock tumbler cylinder. The assembly comprises a handle and three inexpensively made parts which may be assembled on a lock spindle to form a rigid unit without the use of pins or screws.

1 Claim, 5 Drawing Figures

LEVER TYPE DOOR HANDLE

BACKGROUND OF THE INVENTION

Lever type door handles are in extensive use particularly in public buildings because of the relative ease with which they may be actuated to unlatch and open a door as compared with the more difficult task of gripping, turning and pushing or pulling a conventional door knob.

It is common practice in the door handle industry to make lever type handles by the casting process. This process however does not lend itself to economical production in small volume. As a result there are many special situations where lever type handles should be installed but, because of high cost in small volume, less desirable handles are used to the detriment of the public.

SUMMARY OF THE INVENTION

The lever type handle of the present invention functions in conventional manner. The handle is supported on the exterior of the door by a so-called lock spindle, a strong cylindrical element that extends through the door and carries a handle on each end. When the handle is turned, the lock spindle is correspondingly turned to with draw the latch from the striker plate so that the door may be opened by pushing or pulling on the handle.

The lock spindle may include a conventional lock cylinder requiring the use of a key before the handle can be turned to free the door.

The handle is made from a strip of strong but bendable metal permitting the ends to be bent toward the door to render the handle more attractive to the eye and safer from the standpoint of the user.

The other main parts consisting of a hub, a thimble and an internally threaded ring may be readily machined from tubular stock. The lock cylinders of a size to fit the lock spindle may be purchased in the open market.

Figure 1:
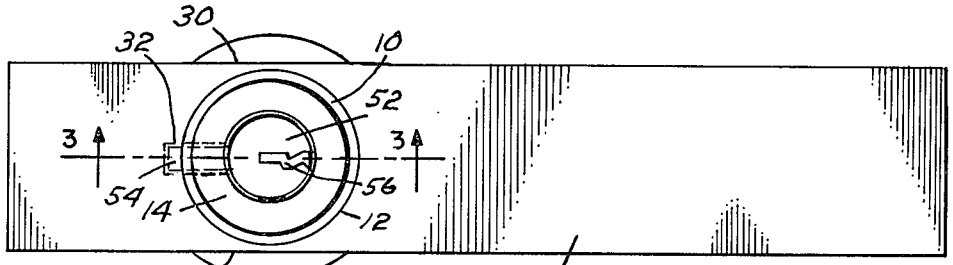
FIG. 1 is a side elevation of the exterior side of the handle.
Figure 3:
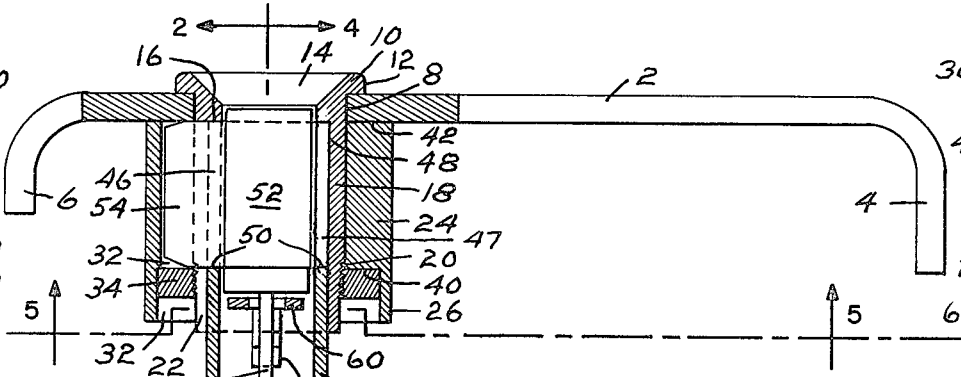
FIG. 3 is a horizontal section taken on the line 3—3 of FIG. 1.

Referring first to FIGS. 1 and 3, the handle is shown at 2. It is made of a strip of relatively thick metal having inturned ends 4 and 6. These ends are formed by bending the material.

Handle 2 has a circular hole 8 therethrough in which is positioned a thimble 10. The thimble may be machined from tubular or solid bar stock to produce a flange 12 which rests on the periphery of hole 8, a chamfered entrance 14, an internal flange 16, a tubular section 18 and external threads 20 near the end thereof.

Figure 2:
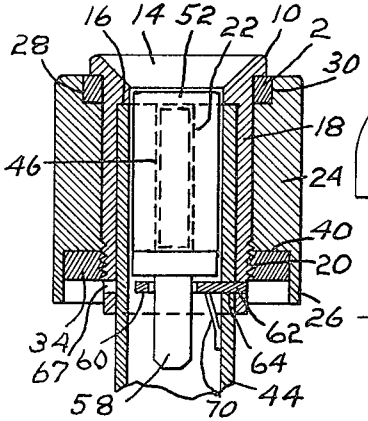
FIG. 2 is a vertical section taken on the line 2—2 of FIG. 3.
Figure 5:
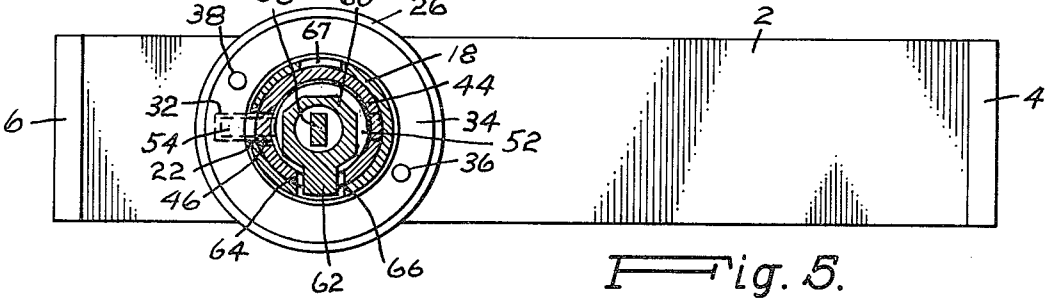
FIG. 5 is a side elevation of the interior side of the handle taken on the line 5—5 of FIG. 3.

The tubular section 18 of thimble 10 is longitudinally slotted from its inner end to flange 16 as indicated at 22 in FIGS. 2, 3 and 5.

Surrounding tubular section 18 is a hub 24 in the form of a relatively thick walled cylinder terminating at its inner end in a short cylindrical wall 26. The outer end of hub 24 has been milled to create two parallel walls 28 and 30 to receive therebetween the handle 2. This construction keys handle 2 to hub 24. The transverse surface of hub 24 between walls 28 and 30 lies flush against the inner side of handle 2.

Hub 24 has a longitudinally extending interior keyway 32 running the full length thereof. This keyway is aligned with slot 22 in thimble 10.

The thimble 10 and hub 24 are firmly secured together and to handle 2 by an interiorly threaded ring nut 34. The exterior circumference of the nut fits freely within wall 26. Two spanner wrench holes 36 and 38 enable the nut to be screwed onto threads 20 whereby when the nut is set up and pressing against shoulder 40 of hub 24, handle 2 will be tightly clamped between flange 12 of thimble 10 and the outer end 42 of hub 24.

Thus through the use of three inexpensive, easily made pieces, a thimble a hub and a nut, a strong tubular support for handle 2 has been established. These parts are all located on the exterior of the door (which is not shown in the drawings but would if shown extend approximately along section line 5—5 in FIG. 3).

In conventional construction in the door handle art, the handle is supported by a lock spindle. This may be in the form of a sufficiently strong cylindrical metal tube such as the tube 44 shown in FIGS. 2 to 5. This tube contains the locking mechanism if used, and when turned by movement of handle 2 releases the latch so that the door may be opened. Since the parts just mentioned do not comprise any part of this invention they are not shown in the drawings.

As can be seen in FIGS. 2 to 5, the lock spindle 44 extends outward from the door (not shown) into the interior of thimble 10. Its outer end abuts flange 16 of thimble 10. Lock spindle 44 has two oppositely disposed longitudinal slots 46 and 47 which start at the end of the spindle and terminate at 50. As will be explained hereinafter, the presence of two slots in spindle 44 makes it possible to mount the handle thereon in either of two positions 180° apart. In the assembly as shown in the drawings, slot 46 is the slot in use and it is aligned with the previously referred to slots, 22 in thimble 10 and 32 in hub 24.

Positioned within the end of lock spindle 44 is a lock cylinder 52. This cylinder has a lengthwise extending key 54 which resides in the aligned slots 22, 32 and 46. Since hub 24 is keyed to handle 2 by the walls 28 and 30 and the key 54 of cylinder 52 is in slot 32 of hub 24, it follows that any turning of handle 2 will compel corresponding turning of hub 24, thimble 10, lock spindle 44 and lock cylinder 52.

Lock cylinder 52 has a keyhole 56 adapted to receive a suitable key by which a tongue 58 may be turned to cause release of a door latch (not shown) to which tongue 58 may be connected.

Withdrawal of lock spindle 44 from thimble 10 is prevented by the use of any convenient means for locking these two parts together. One such means is shown in the spring pressed latch 60 which has a finger 62 extending through an opening 64 in lock spindle 44. This finger moves into the aligned opening 66 in thimble 10.

Figure 4:
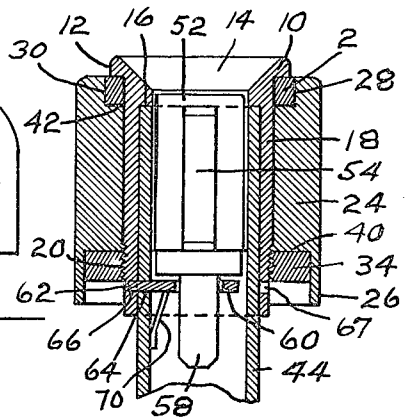
FIG. 4 is a vertical section taken on the line 4—4 of FIG. 3.

The parts are assembled in the following steps. Thimble 10 is inserted into the hole 8 through handle 2. Hub 24 is placed over thimble 10 with slot 22 aligned with keyway 32. Lock cylinder 52 is placed concentrically within thimble 10 with the key 54 located in keyway 32 and slot 22. The walls 28 and 30 of hub 24 straddle the sides of handle 2. Ring nut 34 is then placed between the end of thimble 10 and wall 26 and screwed on the threads 20 as shown in FIGS. 2, 3 and 4. This clamps handle 2 between the end of hub 24 and the flange 12 of the thimble to create a rigid unitary structure in which the cylindrical body of lock cylinder 52 is uniformly spaced from the inner wall of thimble sleeve 18.

The unit is now ready for attachment to lock spindle 44. Lock spindle 44 has previously been mounted in the door in conventional association with the usual latch and bolt. The manner of mounting of spindle 44 permits limited rotation but prevents axial movement.

The slotted end of spindle 44 extending beyond the face of the door is then directed into the cylindrical space between lock cylinder 52 and sleeve 18. As the parts telescope together, the sides of slot 46 straddle key 54 and the cylinder 52 enters the interior of spindle 44.

Full entry of spindle 44 into the unit with the end of the spindle engaging internal flange 16 is achieved by pressing finger 62 inwardly against spring 70 to permit entry within the end of thimble 10. When finger 62 comes into alignment with opening 66 in the thimble, spring 70 then forces finger 62 into the opening to lock thimble 10 and spindle 44 together against relative axial movement.

This completes the installation. The handle 2 is locked and keyed to spindle 44 so that the door lock may be actuated by key rotation of tongue 58 and the latch withdrawn by rotation of handle 2. The size and shape of the handle makes it easy to open the door by pulling or pushing as the case may be.

It will be appreciated that a similar handle unit may be applied to the other end of the spindle 44 on the other side of the door. It will also be recognized that the unit may be mounted on the end of the spindle 44 in a position 180° reversed from that shown in the figures. This is possible because of the second slot 47 in the end of the spindle which permits the key 54 to enter therein. The locking finger 62 when the unit is in the reversed position will no longer be in alignment with opening 66 but will be in alignment with an oppositely disposed second opening 67 in thimble 10. Thus the handle unit may be applied and secured to spindle 44 equally well in two diametrically opposite positions.

By introducing additional slots in spindle 44 and corresponding openings in thimble 10, the number of attaching positions could be increased if desired.

The foregoing description will suggest to others skilled in this art modifications and equivalent structures which will fall within the scope of the appended claims.

I claim:

1. A door handle assembly comprising an elongated metal handle having a circular opening therethrough intermediate the ends thereof, said handle being of substantially uniform thickness and strong enough to meet the loads imposed thereon in the opening and closing of a door to which said assembly may be affixed, a tubular thimble positioned in said opening, said thimble having a circular flange at one end which flange overlies and engages the periphery of said opening on one side of said handle to limit movement of said thimble through said opening, a hub surrounding the extended part of said thimble on the other side of said handle, said hub comprising a short thick walled cylindrical element of greater outside diameter than the width of said handle at the location of said opening, said hub having diametrically opposed extensions that straddle and engage the opposite sides of said handle at the position of said opening to prevent relative rotation between said handle and hub, a longitudinal slot in that part of said thimble on the said other side of said handle and an interior longitudinal keyway in said hub aligned with said slot, a cylinder within and coaxially aligned with said thimble, a key extending radially from said cylinder and positioned in said thimble slot and keyway whereby relative angular movement of said cylinder, thimble and hub is prevented, a ring nut threaded on said thimble and adapted when screwed in the direction of said handle to press in an axial direction against said hub whereby said handle will be clamped between the said flange on said thimble and said hub, the outside diameter of said cylinder and the inside diameter of said thimble providing a cylindrical space interrupted by said key, said space adapted to receive the end of a slotted lock spindle.

* * * * *